US006829785B2

(12) United States Patent
Park

(10) Patent No.: US 6,829,785 B2
(45) Date of Patent: Dec. 14, 2004

(54) GROOVED ADJUSTMENT STRAP FOR A CAP

(75) Inventor: Boo Yl Park, Seoul (KR)

(73) Assignee: Dada Corp., Seoul (KR)

( * ) Notice: Subject to any disclaimer, the term of this patent is extended or adjusted under 35 U.S.C. 154(b) by 155 days.

(21) Appl. No.: 10/281,981

(22) Filed: Oct. 29, 2002

(65) Prior Publication Data

US 2004/0060099 A1 Apr. 1, 2004

(30) Foreign Application Priority Data

Oct. 1, 2002 (KR) ..... 2002-29338

(51) Int. Cl.[7] ..... A42B 1/00
(52) U.S. Cl. ..... 2/195.4
(58) Field of Search ..... 2/181, 181.4, 195.1–195.4, 2/181.2, 181.6, 209.13

(56) References Cited

U.S. PATENT DOCUMENTS 749,228 A * 1/1904 Runyan ..... 2/182.7
2,483,101 A * 9/1949 Nelms ..... 2/181
4,011,600 A 3/1977 Malk
4,023,212 A 5/1977 Huffman
4,274,157 A * 6/1981 Boden ..... 2/181.4
4,481,681 A 11/1984 Hankin
4,630,317 A 12/1986 Brown et al.
4,642,817 A 2/1987 Ferstenfeld
5,384,916 A 1/1995 Portney
5,402,538 A 4/1995 Conrad
5,426,789 A 6/1995 MacLeod
5,724,676 A 3/1998 Amendolia et al.
6,199,214 B1 * 3/2001 Campbell ..... 2/181.6

* cited by examiner

*Primary Examiner*—Katherine Moran
(74) *Attorney, Agent, or Firm*—Piper Rudnick LLP

(57) ABSTRACT

A grooved size adjustment strap for a baseball-style cap having a crown body and a visor. The size adjustment strap, which is attached to the back portion of the lower periphery of the crown, is formed by an inner strap and an outer strap, each strap attached to a respective side of the crown main body along a lower edge thereof. Each of the straps is formed of a reinforcing material such as PVC sheet, with hook or loop material attached thereto, respectively. The outer strap is formed with the PVC sheet faced outwardly and includes a plurality of vertical grooves that facilitate shape formation and retention of the size adjustment device, and also assist in predictable size adjustment.

9 Claims, 2 Drawing Sheets

GROOVED ADJUSTMENT STRAP FOR A CAP

BACKGROUND OF THE INVENTION

1. Field of the Invention

The present invention is related to the field of size adjustment devices for caps and, more particularly, to a grooved strap device for adjusting the size of a cap.

2. Description of the Related Art

Baseball style caps are generally comprised of a crown main body formed by a plurality of panels, a visor portion that is secured to a forward edge of the crown and that extends outwardly therefrom, and a sweatband attached to the inside of the lower periphery of the crown. A size adjustment device may be attached to a back portion of the lower periphery of the crown to adjust the cap to fit a variety of head sizes. The size adjustment device is generally attached by stitching to both ends of the sweat band at the lower periphery of the crown, and may include advertising or other printed material displayed thereon.

Size adjustment devices are generally manufactured by employing separate molds developed specifically to shape materials such as plastic, metal, iron, etc., to create preset size adjustment increments which do not allow infinite adjustability. Hook and loop closures such as Velcro® have also been used, with or without a PVC layer attached thereto, but these often curl up and become deformed with wear and temperature differences, making their use difficult. In addition, such hook and loop devices, lacking preset size adjustments, can also be inconvenient as the wearer may have to manually adjust the cap size several times to get the proper fit to his or her particular head size after the cap has been used by someone else who has adjusted the fit thereof.

Therefore a need exists for a cap size adjustment device that maintains a desirable shape in all temperatures and also allows infinite size adjustment capability, while at the same time being convenient and predictable to adjust.

SUMMARY OF THE INVENTION

In view of the foregoing, one object of the present invention is to provide an improved cap structure that includes a size adjustment device that is infinitely adjustable.

Another object of the present invention is a size adjustment device that can be adjusted and readjusted predictably.

A further object of the invention is a size adjustment device that maintains its shape over extended periods of time and under varying temperature conditions.

A still further object of the invention is a size adjustment device that readily adopts a curvature matching that of the lower edge portion of the crown for increased wearer comfort.

Yet another object of the invention is a size adjustment device that permits display of logos or other symbols.

In accordance with these and other objects, the present invention is directed to a cap having a size adjustment device attached to a lower back portion of the crown. The size adjustment device is formed by an inner strap and an outer strap, each strap attached to a respective side of the crown main body along a lower edge thereof. Each of the straps is formed of a reinforcing material with hook or loop material attached thereto, respectively. The outer strap is preferably formed of a PVC sheet faced outwardly such that words, symbols or other advertising material may be displayed thereon. This outer facing PVC sheet includes a plurality of vertical grooves that facilitate shape formation and retention of the size adjustment device, and also assist in predictable size adjustment.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
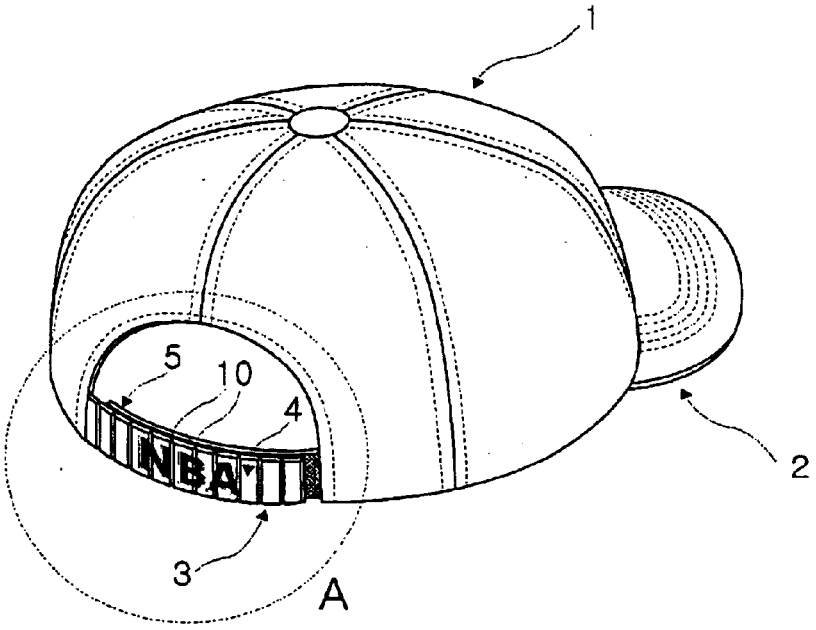
FIG. 1 is a rear perspective view of the grooved size adjustment strap for a cap, in accordance with the present invention.

In describing a preferred embodiment of the invention illustrated in the drawings, although only one preferred embodiment of the invention is explained in detail, it is to be understood that the embodiment is given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

In accordance with a preferred embodiment of the present invention, the present invention is directed to a grooved adjustment strap for a baseball-style cap. As shown in FIG. 1, the present invention provides an improved cap structure comprising a crown main body, generally designated by the reference numeral 1, formed of a plurality of fabric segments or panels, and a visor portion, generally designated by the reference numeral 2, which is secured to a forward edge of the crown and extends outwardly therefrom. At the rear of the cap is a size adjustment device, generally designated by the reference numeral 3, which is attached to a back portion of the lower periphery of the crown 1 to adjust the cap to fit a variety of head sizes. Such a cap also generally includes a headband along the inside edge of the lower periphery of the crown for absorbing perspiration, as is known in the art.

Figure 2:
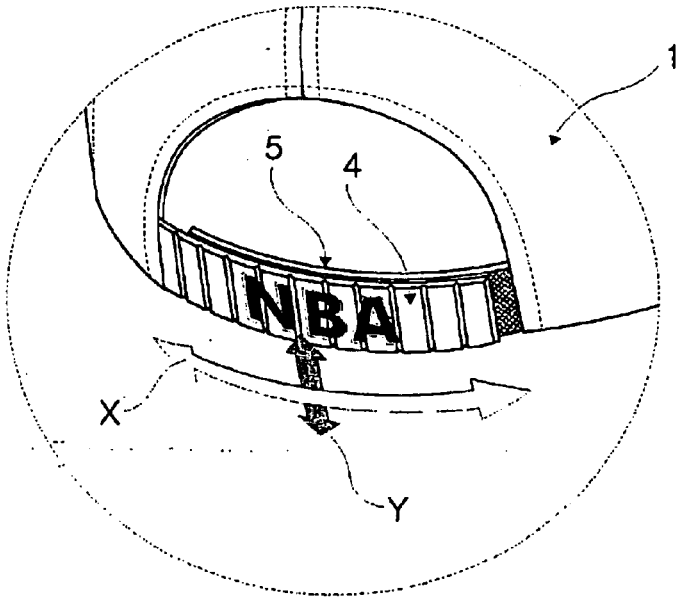
FIG. 2 is an enlarged view of the A portion of FIG. 1.
Figure 3:
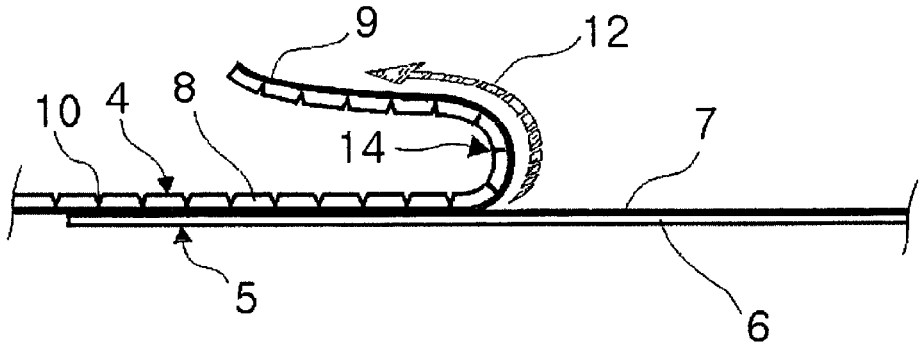
FIG. 3 is a top view of the grooved size adjustment strap of FIG. 1, as it is fastened and loosened.

As shown in the enlarged view of FIG. 2 and the upper view of FIG. 3, the size adjustment device includes an outer strap, generally designated by the reference numeral 4, and an inner strap, generally designated by the reference numeral 5. The inner strip 5 includes a reinforcing material 6 attached to a hook or loop fabric 7. Similarly, the outer strap 4 includes a reinforcing material 8 to which a hook or loop fabric 9, complementary to the hook or loop fabric 7, is attached, i.e., if the inner strap 5 is provided with loop material, the outer strap 4 is provided with hook material, and vice versa. The reinforcing material of the outer strap is preferably thicker than the reinforcing material of the inner strap.

According to a preferred embodiment, the reinforcing material of the outer strap 8 is a PVC sheet. The PVC sheet includes a plurality of vertical grooves 10 therein which are preferably formed within the mold when the PVC sheet 8 for the size adjustment device is originally made.

As shown in FIG. 2, the grooves in the PVC sheet 8 facilitate the continuance of the same line of curvature defined by the crown portion of the hat, indicated by the arrow X. With such curvature, comfort for the wearer is enhanced as the size adjustment device naturally wants to conform to the wearer's head. The grooves also provide a supporting function in the vertical direction along line Y, preventing the size adjustment device from curling laterally and becoming deformed, whether due to temperature changes, moisture, prolonged use, etc.

The grooves 10 may be spaced as desired, whether at regular or odd intervals, with narrow or wide gaps, etc. As shown by the curved portion 12 of the straps, the width of the grooves, generally indicated by reference numeral 14, is reduced when the outer strap is pulled back upon itself to separate such strap from the inner strap. The depth of grooves is preferably approximately half a thickness of the PVC sheet or greater, to provide good flexibility.

Because the grooves allow for greater bending of the outer strap with less effort as shown, the straps can be fastened and loosened more easily than in the case of a PVC strap without grooves. This enhanced ease of use is particularly significant in cooler temperatures when the straps tend to become stiffer.

The grooves also provide a visual means of selecting a size adjustment setting prior to wear. The user may know, for example, that the cap fits well when the inner strap aligns with the fourth vertical groove of the outer strap. In this way, the cap may be effectively adjusted in one step, without repeated trying-on of the cap to determine correct adjustment after the straps have been separated from one another, such as may occur if the cap is worn by another person.

The size adjustment device may be formed by sewing textile or fabric and hook and loop material such as Velcro® together, or by sewing a PVC sheet and hook and loop material together.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the size adjustment device may be incorporated into other clothing items such as cuffs on jackets or turtlenecks. Therefore, it is not desired to limit the invention to the specific examples disclosed or the exact construction and operation shown and described. Rather, all suitable modifications and equivalents may be resorted to, falling within the scope of the invention.

What is claimed is:

1. A baseball-style cap comprising:

a crown portion with a lower peripheral edge; and a size adjustment device attached to said lower peripheral edge of said crown at a back portion thereof, said size adjustment device including an outer strap composed of a PVC sheet attached to hook or loop material, and an inner strap composed of a reinforcing material attached to hook or loop material complementary to said outer strap, said PVC sheet of said outer strap including a plurality of vertical grooves therein.

2. The baseball-style cap as set forth in claim 1, wherein said plurality of vertical grooves are spaced at regular intervals.

3. The baseball-style cap as set forth in claim 1, wherein said plurality of vertical grooves are integrally formed with said PVC sheet during molding thereof.

4. The baseball-style cap as set forth in claim 1, wherein a depth of said plurality of vertical grooves is approximately half a thickness of said PVC sheet.

5. The baseball-style cap as set forth in claim 1, wherein a depth of said plurality of vertical grooves is more than half a thickness of said PVC sheet.

6. The baseball-style cap as set forth in claim 1, wherein said material of said inner strap is a PVC sheet.

7. The baseball-style cap as set forth in claim 1, wherein said PVC sheet of said outer strap is thicker than said PVC sheet of said inner strap.

8. The baseball-style cap as set forth in claim 1, wherein said material of said inner strap is a textile material.

9. The baseball-style cap as set forth in claim 1, wherein said outer strap includes a graphic image for display.

* * * * *